US010874186B2

(12) United States Patent
MacPherson et al.

(10) Patent No.: US 10,874,186 B2
(45) Date of Patent: Dec. 29, 2020

(54) ATTACHMENT FOR A HAIR DRYER AND A METHOD OF BLOW DRYING HAIR USING SUCH AN ATTACHMENT

(71) Applicant: John MacPherson, London (GB)

(72) Inventors: John MacPherson, London (GB); Gordon Brand, Warnham (GB)

(73) Assignee: John MacPherson, London (GB)

( * ) Notice: Subject to any disclaimer, the term of this patent is extended or adjusted under 35 U.S.C. 154(b) by 70 days.

(21) Appl. No.: 16/333,751

(22) PCT Filed: Sep. 15, 2017

(86) PCT No.: PCT/GB2017/052738
§ 371 (c)(1),
(2) Date: Mar. 15, 2019

(87) PCT Pub. No.: WO2018/051113
PCT Pub. Date: Mar. 22, 2018

(65) Prior Publication Data

US 2019/0357654 A1 Nov. 28, 2019

(30) Foreign Application Priority Data

Sep. 16, 2016 (GB) ..... 1615775.2

(51) Int. Cl.
*A45D 20/12* (2006.01)

(52) U.S. Cl.
CPC ..... *A45D 20/122* (2013.01)

(58) Field of Classification Search
CPC ..... A45D 20/122
See application file for complete search history.

(56) References Cited

U.S. PATENT DOCUMENTS

| | | | | |
|---|---|---|---|---|
| 3,835,869 A * | 9/1974 | Newman | A45D 20/52 | 132/271 |
| 4,827,105 A * | 5/1989 | Brown, Jr. | A45D 20/12 | 219/222 |
| 2010/0024837 A1* | 2/2010 | Obermann | A45D 20/122 | 132/223 |
| 2016/0051026 A1* | 2/2016 | Torres | A45D 19/16 | 132/272 |
| 2017/0245614 A1* | 8/2017 | Porter | A45D 20/122 | |

FOREIGN PATENT DOCUMENTS

| | | |
|---|---|---|
| BE | 862485 | 4/1978 |
| CH | 661643 | 8/1987 |
| WO | 2004/045334 | 6/2004 |
| WO | 2008/062357 | 5/2008 |

OTHER PUBLICATIONS

International Search Report for PCT/GB2017/052738 dated Nov. 16, 2017.

* cited by examiner

*Primary Examiner* — David J Laux
(74) *Attorney, Agent, or Firm* — Christopher M. Scherer; DeWitt LLP

(57) ABSTRACT

Disclosed herein is a hairdryer attachment. The hairdryer attachment comprises an inlet section for receiving a flow of air in a first direction and an outlet section. A plurality of air channels are located within the outlet section for turning and separating the flow of air into a plurality of streams of air. The air channels are arranged such that the streams of air exit the outlet section in a plurality of different directions.

15 Claims, 7 Drawing Sheets

ATTACHMENT FOR A HAIR DRYER AND A METHOD OF BLOW DRYING HAIR USING SUCH AN ATTACHMENT

CROSS-REFERENCE TO RELATED APPLICATIONS

The present application is the U.S. national stage application of International Application No. PCT/GB2017/052738, filed Sep. 15, 2017, which international application was published on Mar. 22, 2018, as International Publication No. WO2018/051113. The International Application claims priority to British Patent Application No. 1615775.2, filed Sep. 16, 2016, the contents of which are incorporated herein by reference in their entireties.

BACKGROUND TO THE INVENTION

In order to achieve a sleek and smooth finish when blow drying hair, it is necessary to direct the flow of air down the hair shaft, over a brush, so that the cuticles lie flat, resulting in hair with a desired shine. For a trained hair stylist this is not always easy to achieve successfully despite their ideal view point when blow drying relative to the client's hair. It is particularly difficult for someone drying their own hair to achieve this effect due to the awkward angles involved and the fact that they have to work with two tools at once: a hairdryer and a hairbrush.

In order to achieve the desired result, the hair must first be sectioned and wrapped around the brush; the nozzle of the hair dryer must then be orientated against the brush at the correct angle. The hairbrush is then moved through the hair, with the hairdryer following it, all the time maintaining the correct angle and tension of the hair against the brush. Even for a professional hair stylist, mastering this technique is not a trivial or easy task, and requires significant training and practice. An inexperienced stylist may struggle to achieve the desired effect at first, resulting in a dissatisfied customer.

For the untrained person at home, it is considerably more difficult to achieve a salon style blow dry. During the process of blow drying it is usual practice to look in a mirror. However, as the image observed in the mirror is a reflection, this often causes confusion about the direction of movement, with this lack of co-ordination making it difficult to maintain the required angles and tension, resulting in the blow dried hair becoming frizzy and dull. For this reason, it is often the case that the glossy finish and long lasting effect experienced from a blow dry from a professional hair stylist cannot be achieved at home.

A further issue that can be caused by the failure to maintain the correct angle during blow drying is heat damage to the hair, arising from the hot air flow being concentrated directly onto the hair, rather than over it.

In addition, during the blow drying process, professional hair stylists generally hold their arms above shoulder level or in an abducted posture for prolonged periods of time. Hair stylists also bend and twist their backs whilst blow drying hair, and make repetitive and forceful movements with the brush and hairdryer, in order to achieve the desired salon finish. However, this can ultimately lead to muscular skeletal disorders or pain in the shoulders, elbows, wrists, hands and lower back. In severe cases, this can reduce a hair stylist's career, as the repetitive actions associated with blow drying hair can become too painful to carry out. This has become such a pressing issue in the field of hairdressing that the European Agency for Safety and Health published a document entitled "Occupational Health and Safety in the Hairdressing Sector" in 2014, which aims to prevent injuries in hair stylists.

SUMMARY OF INVENTION

According to an aspect of the invention there is provided a hairdryer attachment. The hairdryer attachment comprises: an inlet section for receiving a flow of air in a first direction, an outlet section, and a plurality of air channels located within the outlet section for turning and separating the flow of air into a plurality of streams of air. The air channels are arranged such that the streams of air exit the outlet section in a plurality of different directions.

Conventional hairdryer attachments generally comprise a narrow funnel in order concentrate and direct the flow of air in one direction. The hairdryer is then continually moved to maintain the correct angles during blowdrying.

The hairdryer attachment according to the present invention enables air to be directed such that it exits the attachment at a range of angularly offset directions. Therefore, the angle of orientation of the hairdryer does not have to be continually adjusted whilst drying the hair. Advantageously, the user does not have to adjust their posture as frequently to ensure that the correct angle of air flow across the hair is maintained. This may lead to improved posture of the user, and may reduce the undesirable health effects associated with maintaining awkward postures.

A further advantage is that the attachment makes it easier to direct the flow of air at the correct angle throughout the blow drying process. The air channels provide well-defined paths for the air to flow through. Therefore, as the angular flow of air is determined by the device, even untrained users can ensure that the correct angles are maintained throughout use.

Preferably, the outlet section comprises an arcuate portion, with the plurality of air channels arranged around the arcuate portion in successively angularly offset directions relative to each other. Advantageously, the arcuate portion provides a region into which a rounded hairbrush can be placed when in use. The arcuate portion accommodates the rounded barrel brush. The barrel of the hairbrush may be a cylinder or a semi cylinder. Air exiting the air channels is guided over the hairbrush during the blowdrying process. Optionally, the air channels are arranged such that each of the streams of air exits in different directions to each other, i.e. no two streams of air exit in the same direction.

Preferably, the plurality of air channels are arranged such that the streams of air exit substantially tangentially to a curve defined by the arcuate portion. This ensures that air is directed around the brush such that air is directed over the hair at the correct angle. This helps prevent damage to the hair creating a sleek and smooth finish.

The radius of curvature of the arcuate portion may be at least 2 cm. More preferably, it would be at least 2.5 cm. The radius of curvature of the arcuate portion may be of any size sufficient to accommodate a rounded hairbrush. Preferably, the radius of curvature of the arcuate portion can accommodate a range of rounded hairbrushes of different sizes. For instance, with a radius of curvature of 2.5 cm the arcuate portion can accommodate brushes with a diameter from 1 cm, to 7 cm. This is further aided by the compression of the brush bristles enabling brushes with larger diameter to be accommodated. Advantageously, this allows the same hairdryer attachment to be used in a wide range of situations, with a wide range of different size rounded hairbrushes, for users with a wide range of hair types.

Preferably, adjacent air channels are of different lengths. In one example hairdryer attachment the air channels may be shorter at one end of the arcuate portion than the air channels at the other end of the arcuate portion. In addition, or alternatively, the length of each of the air channels may be different to each other. In some example hairdryer attachments the length of successive air channels may gradually increase from one end of the arcuate portion to the other end of the arcuate portion.

In one example hairdryer attachment the outlet section may have a hooded shape, due to the arrangement of air channels with different lengths around the arcuate portion.

Preferably, the air channels are defined by a plurality of vanes. The vanes provide a conduit for the air in each of the air channels to flow through. The flow of air is directed by the vanes turning and separating it into the plurality of streams of air. The length of the vanes is preferably dependent on the length of the air channels.

Preferably, the vanes are curved over at least a section of their length. The curvature of the vanes promotes turning of the air flow within the air channels. Optionally, some of the vanes may have a greater curvature than other vanes.

Preferably, the vanes are connected to side walls. The side walls prevent air exiting the hairdryer attachment before it has substantially passed through the length of the air channels. This enables a steady high power flow of air from the hairdryer, ensuring that all of the air is directed across the hair with minimal losses.

Preferably, there are at least three air channels. More preferably, there are at least five air channels. In one example hairdryer attachment there may be six air channels. Having a plurality of air channels enables greater control and direction of the air flow whilst delivering airflow across the hair at a range of angles.

Preferably, the inlet section is a cylindrical section, for attaching to an outlet of a hairdryer. In other alternative hairdryer attachments the inlet section may be any shape to match the shape of the hairdryer to which it is to be attached to. For instance, in one example hairdryer attachment the inlet section may have an elliptical shape. The inlet section may attach to the hairdryer by any suitable attachment method. For instance the attachment may be a push fit or a screw fit. In some example hairdryer attachments the inlet section may comprise one or more retaining clips for attaching to the outlet of a hairdryer. Alternatively, the inlet section may comprise one or more threads for receiving the corresponding thread on a hairdryer. Alternatively, the inlet section may be attached to the hairdryer using magnetic attachments on either, or both, of the inlet section of the hairdryer attachment and the outlet of the hairdryer. Alternatively, magnetic attachments may be in addition to having a push fit. Advantageously, these connectors enable easy detachment of the hairdryer attachment from the hairdryer.

Although it is preferable that the hairdryer attachment is detachable from a hairdryer, it can be envisaged that the hairdryer attachment could be unitary with a hairdryer. This would be advantageous for uses where no other hairdryer attachments are required.

In some example hairdryer attachments the inlet section further comprises a rotatable joint. This enables articulation of the attachment with respect to the hairdryer. This can aid in the ease of use of the device. The rotatable joint may provide an index-able positioning system, allowing the hairdryer attachment to be locked at various angles of rotation.

Preferably, the hairdryer attachment is manufactured from high temperature plastic. This is advantageous to help withstand high temperatures during use. Preferably, the high temperature plastic has a working temperature at least 105° C. More preferably, the high temperature plastic has a working temperature of at least 150° C. The high temperature plastic may be any of Polycarbonate/Acrylonitrile Butadiene Styrene, nylon based plastics, Zytel™, Crastin™, Vespel™, Ryton, Noryl™, polyamide-imides such as Torlon. The hairdryer attachment may be coated with high temperature ceramic coating which may provide further heat resistance. Advantageously, the ceramic coating ionises air molecules to prevent static build up and aids air flow velocity.

The hairdryer attachment may be manufactured using any manufacturing method, including 3D printing or injection moulding. For instance, the 3D printing may be additive or subtractive methods. Preferably, the hairdryer attachment is manufactured as three separate pieces. However, it can be envisaged that some example hairdryer attachments may be manufactured from any number of pieces, including a unitary piece.

According to a further aspect of the invention there is provided a hairdryer comprising the attachment according to an aspect of the invention. Preferably, the hairdryer attachment is detachable from the hairdryer.

According to a further aspect of the invention, there is provided a method for blow drying hair with the hairdryer attachment according to the invention. The method comprising the steps of;

(i) placing a section of hair around a brush;
(ii) positioning the brush adjacent the outlet section of the hairdryer attachment;
(iii) directing a flow of air from the hairdryer over the hair;
(iv) simultaneously pulling the hairdryer and brush towards free ends of the hair, such that the flow of air is brought into contact with the length of the section of hair and;
(v) repeating steps (i) to (iv)

Preferably, the brush in step (i) is placed close to the roots of the hair, and the hair is held tautly around the brush. Preferably, during step (iii), the section of hair is held in place for 5 to 10 seconds, with the air flowing from the hairdryer to the brush, before commencing step (iv), so as to dry the hair partially.

Preferably, step (iv) is repeated until the section of hair placed around the brush is completely dry. Steps (i) to (iv) are repeated for further sections of hair, preferably until all sections are dry.

According to a further aspect of the invention there is provided a computer-readable medium having computer-executable instructions adapted to cause a 3D printer to print the hairdryer attachment according to the invention in an additive manufacturing process.

The hairdryer attachment according to the present invention provides numerous advantages over conventional hairdryer attachments when blowdrying hair. The ease of use of the hairdryer attachment, for instance the intuitive engagement of the hairbrush by the arcuate portion, can enable salon quality blowdry to be achieved by an inexperienced user.

When used in combination with the new blowdrying technique, blowdrying times can be greatly decreased by up to 28%. Not only does this increase efficiency of use, but as the hair is exposed to hot air for a shorter time period, it may also lead to less damage to the hair. Furthermore, the well-controlled direction of the air at the correct angle across the hair, rather than directly onto the hair itself, may lead to a further reduction in damage to the hair.

DETAILED DESCRIPTION

The following description is presented to enable any person skilled in the art to understand the hairdryer attachment, and is provided in the context of particular applications. Various modifications to the disclosed embodiments will be readily apparent to those skilled in the art.

Figure 1A:
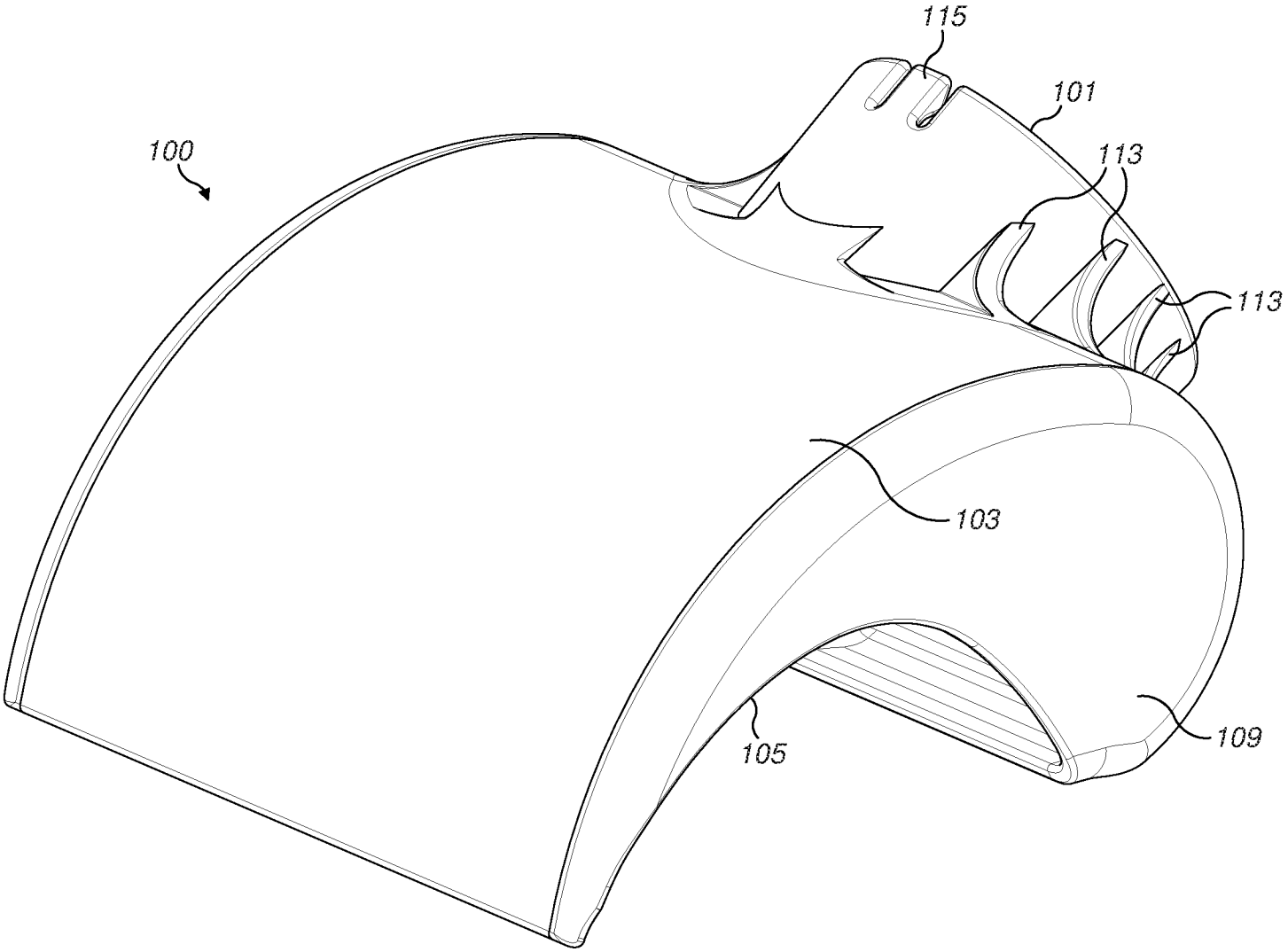
FIG. 1A illustrates a side and front view of an example hairdryer attachment as viewed from above.
Figure 1B:
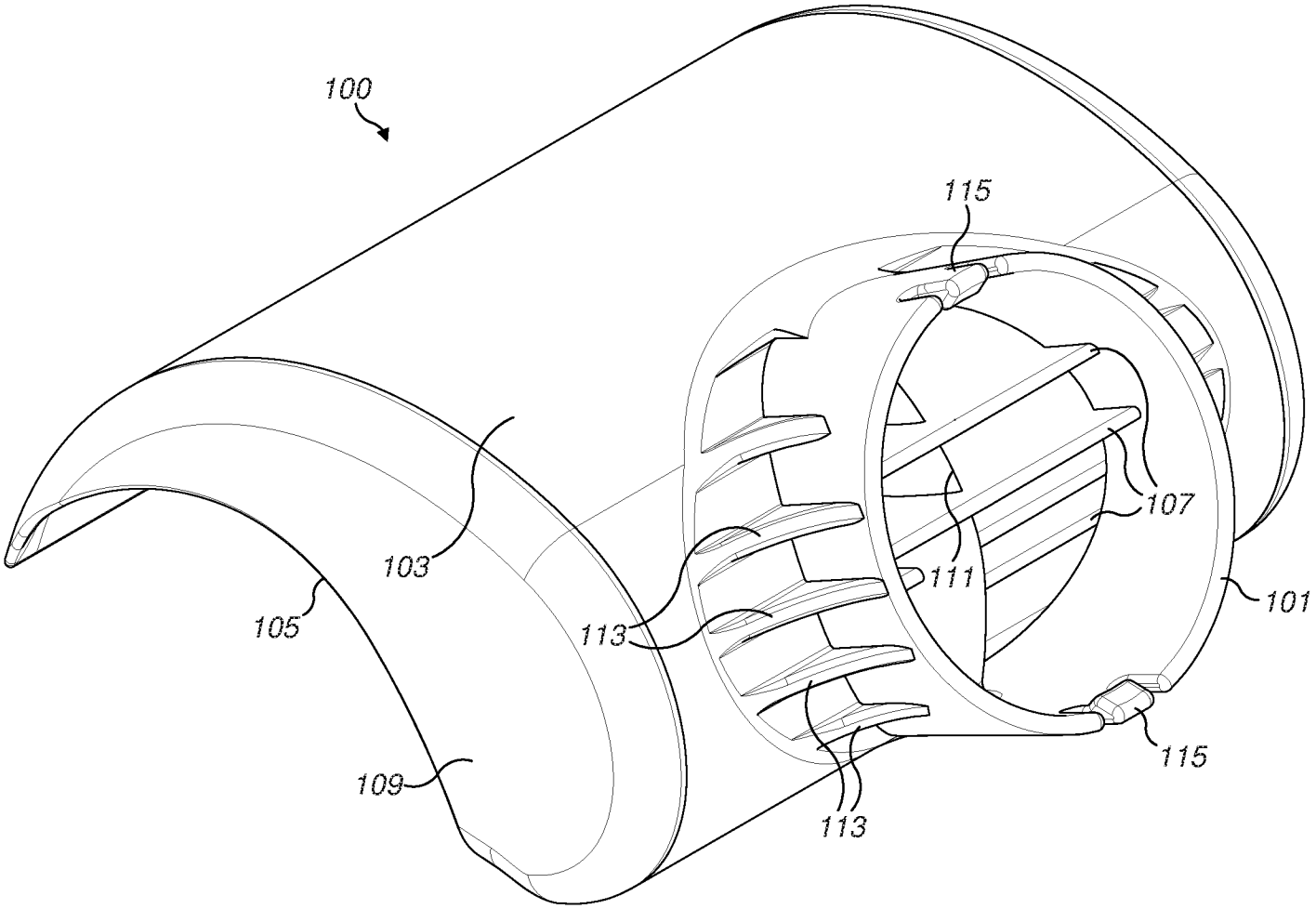
FIG. 1B illustrates a side and rear view of an example hairdryer attachment as viewed from above.
Figure 1C:
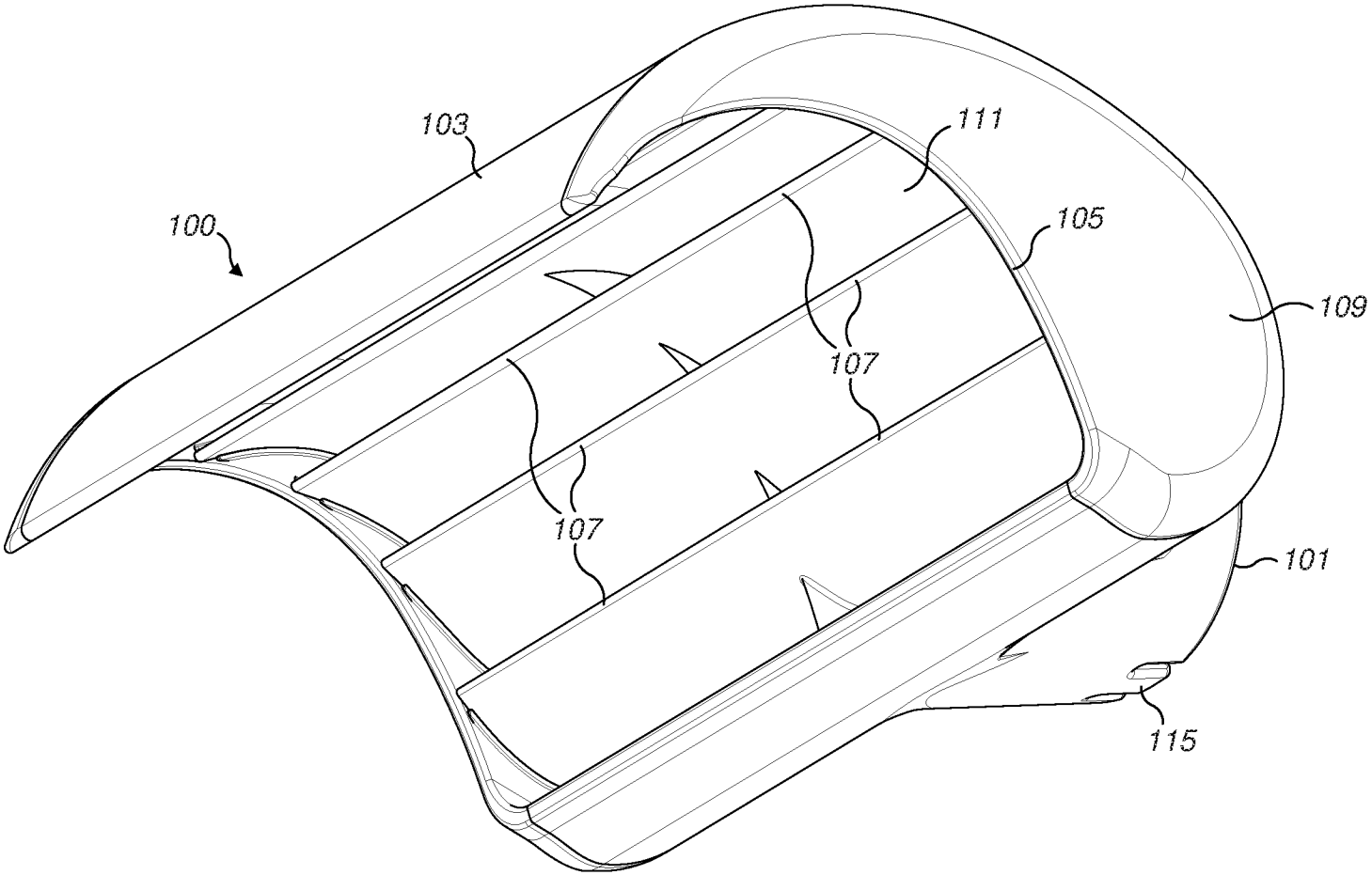
FIG. 1C illustrates a side and front view of an example hairdryer attachment as viewed from below.

FIGS. 1A, 1B and 1C illustrate various orientations of an example hairdryer attachment 100 according to the present invention. FIGS. 1A and 1B illustrate a front, and rear, view of the example hairdryer attachment 100 respectively, as viewed from above. FIG. 1C illustrates a front view of the example hairdryer attachment 100 as viewed from below.

As shown in FIGS. 1A, 1B and 1C the example hairdryer attachment 100 has an inlet section 101. The inlet section 101 is cylindrical, however in alternative example hairdryer attachments 100 it can be any shape suitable to accommodate the outlet of a hairdryer.

Extending from the inlet section 101 is an outlet section 103. The outlet section 103 has an arcuate portion 105. The arcuate portion 105 is a curved region of the outlet section 103. As shown in FIGS. 1A to 1C the arcuate portion 105 defines the region of the outlet section 103 that is distal to the inlet section 101.

A number of vanes 107 are arranged around the arcuate portion 105. As can be seen from comparing FIGS. 1B and 1C, the vanes 107 extend through the outlet section 103, towards the inlet section 101.

Either side of the outlet section 103, in a plane perpendicular to the direction which the vanes 107 extend through the outlet section, are two side walls 109. The vanes 107 and side walls 109 define air channels 111 of the hairdryer attachment 100 through which air can flow.

Figure 1D:
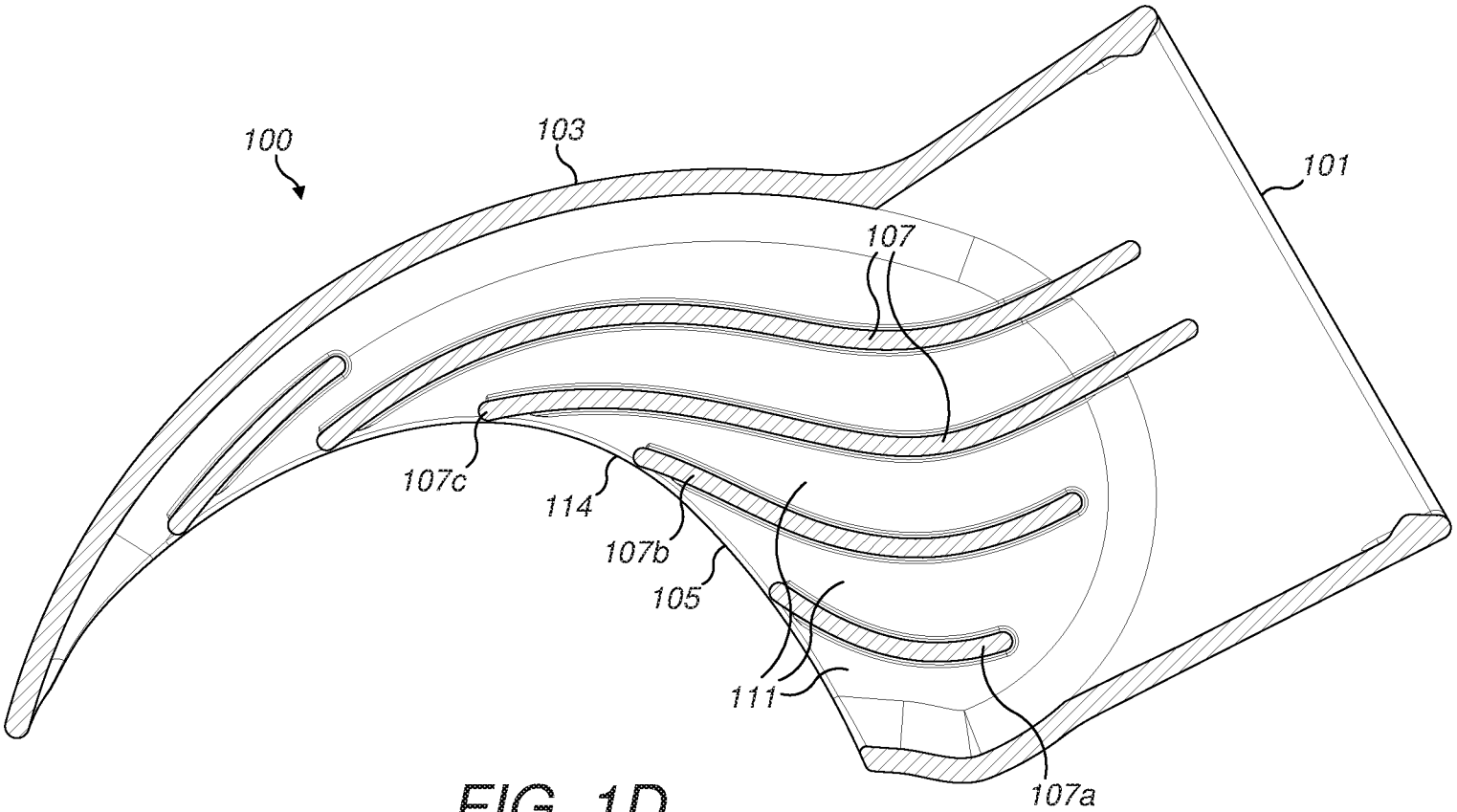
FIG. 1D illustrates a side view cross section arrangement of an example hairdryer attachment.

The arrangement of the vanes 107 is more readily visualised in FIG. 1D, which illustrates a side view cross section of the example hairdryer attachment 100 of FIGS. 1A to 1C.

The vanes 107 are arranged around the arcuate portion 105 in various orientations to one another. The orientation of the vanes 107 around the arcuate portion 105, is in successively angularly offset directions, which results in the air channels 111 having successively angularly offset directions.

Due to the arrangement of the arcuate portion 105, each subsequent vane 107 arranged around the arcuate portion 105 extends further relative to the inlet section 101, to its adjacent vane 107. For instance, vane 107*b* extends further than vane 107*a* relative to the inlet section 101, and vane 107*c* extends further to both vanes 107*a* and 107*b*. This results in the outlet section 103 having a hooded shape, with the vanes closer to the hood extending further relative to the inlet section 101, than the vanes 107 further from the hood.

Each of the vanes 107 have different curvatures to one another. For instance, from FIG. 1D it can be seen that vane 107*a* curves in one direction. However, vane 107*c* curves initially in one direction, before curving in a different direction closer to the arcuate portion 105. Having vanes 107 with various curvatures to one another, leads to the air channels 111 having various profiles.

Furthermore, it can be seen that in this example hairdryer attachment 100 the vanes 107 are of different lengths to one another. For instance, vane 107*a* is shorter than vane 107*b*.

It can be seen in FIG. 1D that the vanes 107 define six air channels 111. However, in other alternative example hairdryer attachments there can be fewer, or greater numbers of air channels 111. For instance, there could be three air channels 111. However, having at least five air channels 111 is preferable.

Each vane 107 is supported by a support region 114 extending the length of the arcuate portion 105.

Referring back to FIGS. 1A to 1C, arranged around the inlet section 101 are a series of support ribs 113. The support ribs 113 are attached between the inlet section 101 and the outlet section 103 to help support the cylindrical inlet section 101 against the outlet section 103.

Two bezel retaining clips 115 are located on the inlet section 101, for attaching the inlet section 101 to a hairdryer. The clips 115 are arranged on opposite sides of the inlet section 101 to one another. The clips 115 are movable in relation to the circular cross-section of the inlet section 101, such that they can engage with the end of the hairdryer. In other alternative hairdryer attachments there could be any number of bezel retaining clips 115 arranged around the inlet section 101. Alternatively, any other attachment mechanism could be used including threaded screw fits, or push interference fits.

Figure 2:
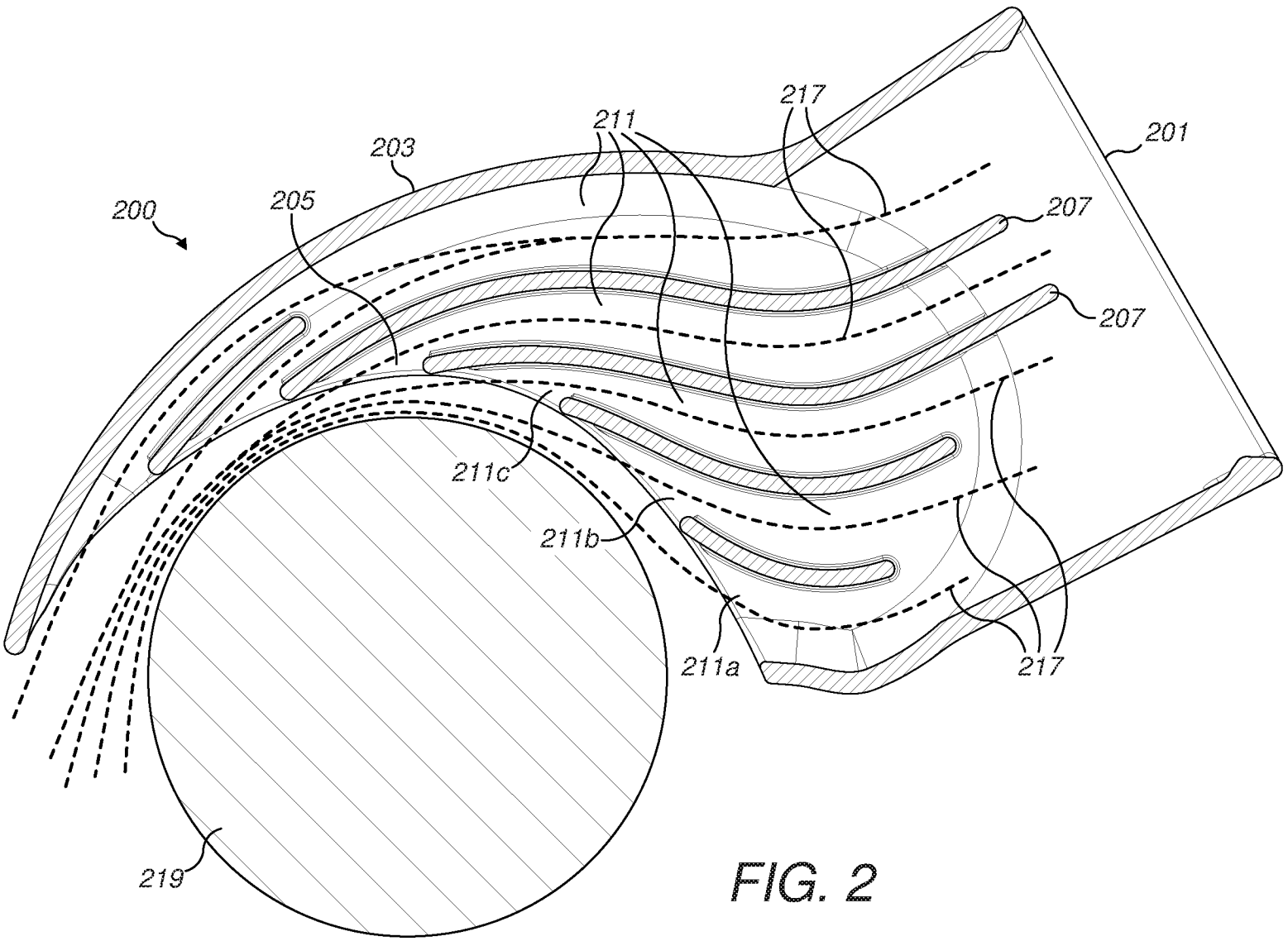
FIG. 2 illustrates a side view cross section arrangement of an example hairdryer attachment, showing the direction of airflow through the example hairdryer attachment onto a hairbrush.

FIG. 2 illustrates an example side view cross section arrangement of the example hairdryer attachment 200 of FIGS. 1A-1D, showing the direction of airflow through the example hairdryer attachment 200 onto a hairbrush 219.

Each of the features of the example hairdryer attachment 200 in FIG. 2 are the same as the example hairdryer attachment 100 in FIG. 1D. However, in FIG. 2 a round hairbrush 219 is received within the arcuate portion 205 of the outlet section 203. The radius of curvature of the arcuate portion 205 is such that it enables the arcuate portion 205 to comfortably encompass the round hairbrush 219.

In this example hairdryer attachment 200 shown in the FIG. 2 the arcuate portion has a radius of curvature of 2.5 cm. This can comfortably encompass rounded hairbrushes of various sizes. For short hair a brush with a diameter of between 1.3 cm and 3.7 cm can be used with the example hairdryer attachment 200. This may be used for more intricate styling work. For medium hair a brush with a diameter of between 2.5 cm and 5.5 cm can be used with the example hairdryer attachment 200. For long hair a brush with a diameter of between 4.3 cm and 6.8 cm can be used with the example hairdryer attachment 200.

When in use, air enters into the example hairdryer attachment 200 through the inlet section 201. The air is then separated by the vanes 207 into each air channel 211, creating a series of streams of air 217.

As can be seen, the air initially enters into the inlet section 201 in a first direction. The arrangement of the vanes 207 then causes the air in each air channel 211 to rotate and thereby turn in a range of different directions following the shape of the vanes 207. The streams of air 217 then pass out of the outlet section 203 via the arcuate portion 205 onto the hairbrush 219. The streams of air 217 exit the outlet section 203 in a plurality of different directions to one another. As can be seen in this example no two streams of air exit in the same direction.

It can be seen that the orientation of the vanes 207 around the arcuate portion 205 causes the air to exit each of the air channels 211 approximately in a tangential direction relative to the circumference of the round hairbrush 219. Furthermore, as the air exits each subsequent air channel 211, the air may be drawn by the air from the adjacent air channel 211. For instance, air from air channel 211*a* exits the outlet section 203 tangentially to the hairbrush 219. Air from air channel 211*b* then exits tangentially to the hairbrush 219, and is drawn by the air flow from air channel 211*a*.

The arrangement of the vanes 207 enables air to be directed around the hairbrush 219. This ensures air is directed across the surface of the hair.

Figure 3:
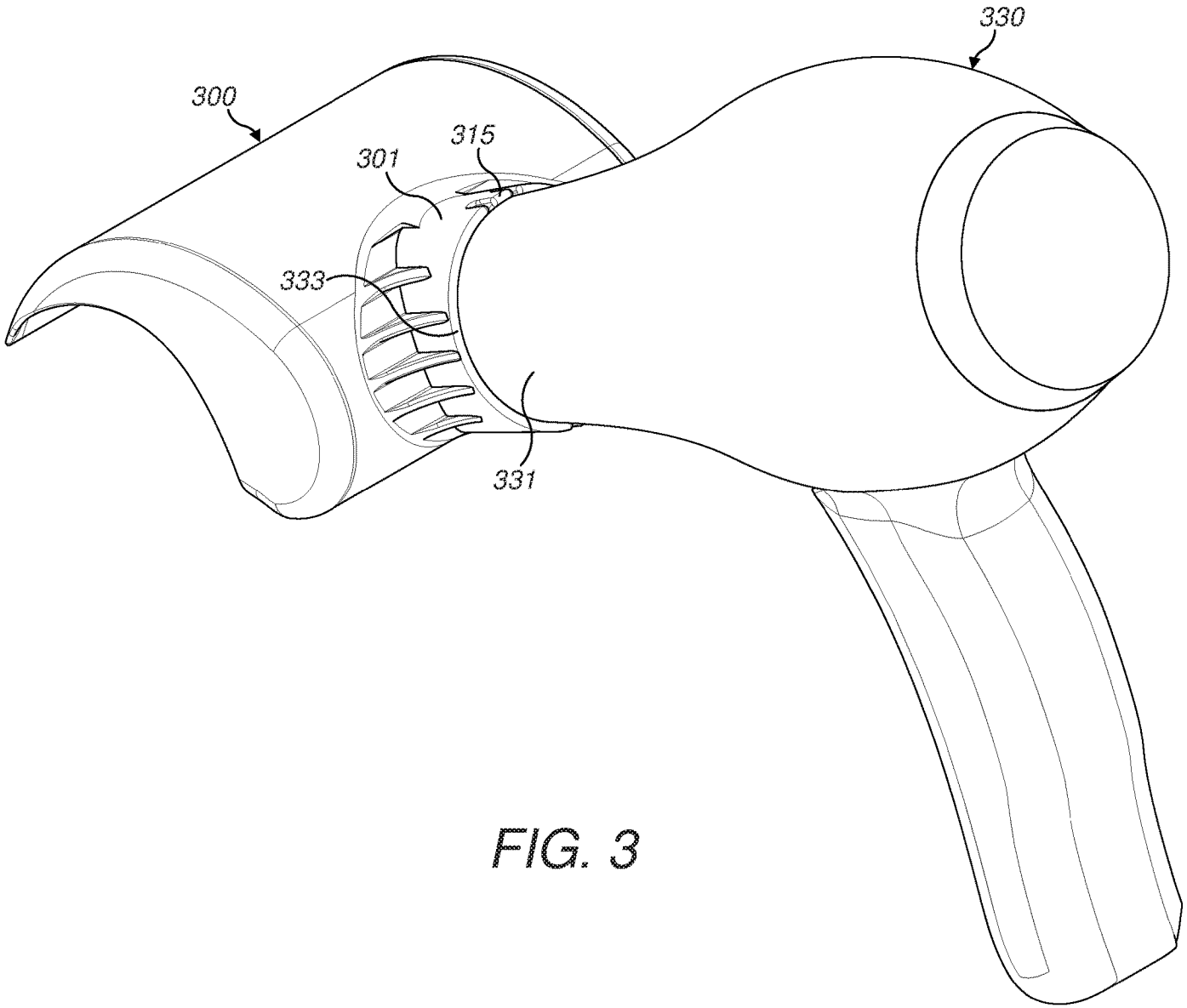
FIG. 3 illustrates an example arrangement of an example hairdryer attachment attached to a hairdryer.

FIG. 3 illustrates an example arrangement of the example hairdryer attachment 300 of FIGS. 1 to 3 when attached to a hairdryer 330. As shown, the inlet section 301 of the example hairdryer attachment 300 is received by the outlet 331 of the hairdryer 330. The two bezel retaining clips 315 are attached to a rim 333 located around the circumference of the outlet 331 of the hairdryer 330. This provides a secure attachment that enables the example hairdryer attachment 300 to be detached from the hairdryer 330 when not required.

When in use, a flow of air is directed through the outlet 331 of the hairdryer 330 into the inlet section 301 of the example hairdryer attachment 300. The air then flows through the example hairdryer attachment 300, as shown and described in FIG. 2.

In the arrangement shown in FIG. 3 the fixing of the example hairdryer attachment 300 to the hairdryer 330, does not permit the hairdryer attachment 300 to move relative to the hairdryer 330 when attached. However, in other alternative example hairdryer attachments, the hairdryer attachment 300 may be rotatable around the outlet 331 of the hairdryer 330. For instance, this may be enabled by the bezel retaining clips 315 rotating around the rim 333 of the outlet 331 of the hairdryer 330. Alternatively, in other example hairdryer attachments 300 there may be a rotatable joint, that enables rotation of the hairdryer attachment 300 relative to the hairdryer 330.

Figure 4:
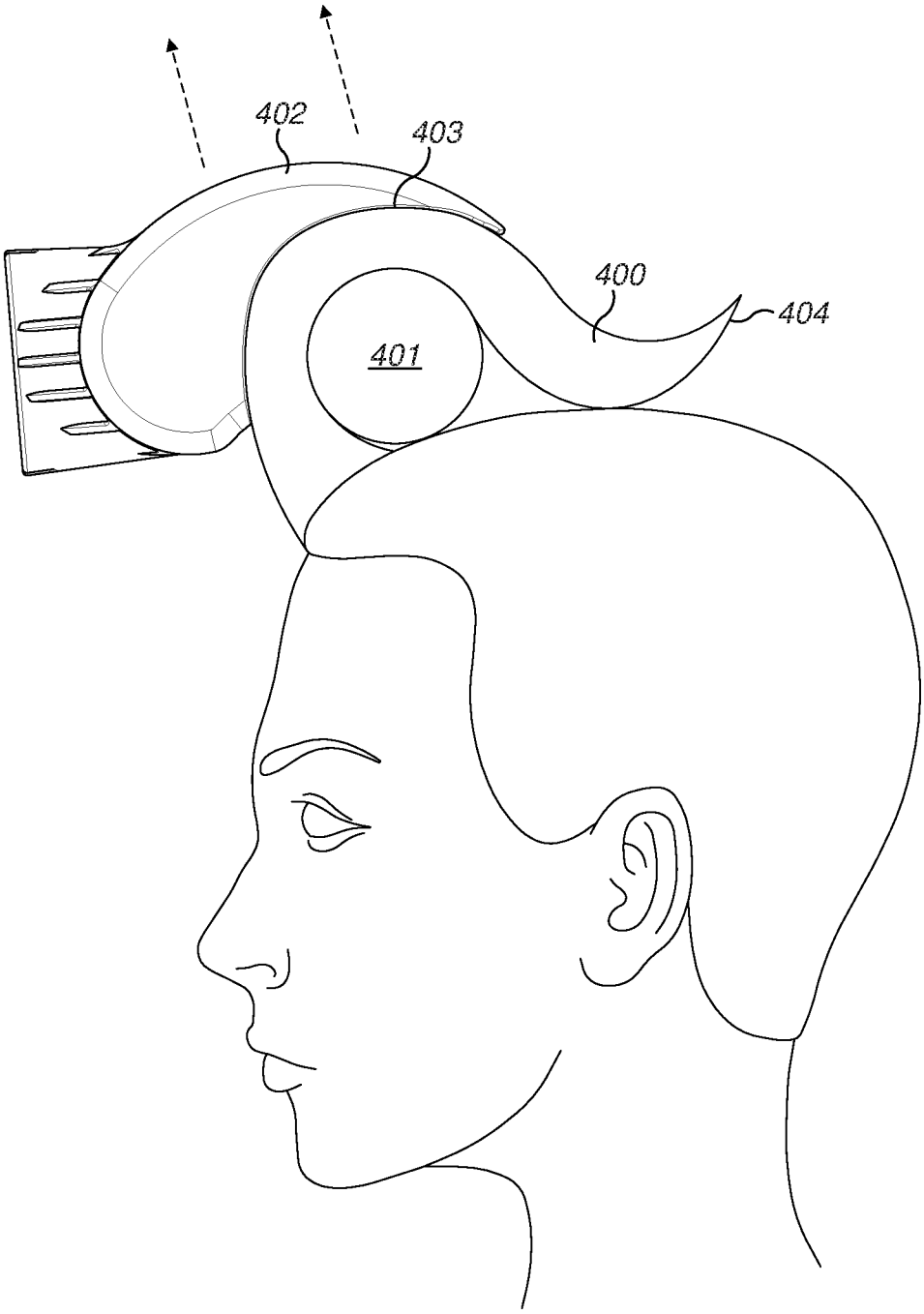
FIG. 4 illustrates an example method for using a hairdryer attachment according to the present invention.

FIG. 4 illustrates an example method for using a hairdryer attachment 402 according to the present invention.

Firstly, a section of hair 400 is placed around a brush 401 and positioned adjacent the outlet section of the hairdryer 403. The arcuate portion of the hairdryer attachment accommodates the brush as shown in FIG. 4. The hairdryer is then switched on and directs a flow of air over the brush. Optionally, the hairdryer can be held in this position, as shown in FIG. 4, for five to ten seconds, so as to partially dry the hair. The user then simultaneously pulls the hairdryer and brush towards the free ends of the hair 404, as indicated by the arrows in FIG. 4. This ensures that the flow of air is brought into contact with the length of the section of hair. The user then repeats this method for the section of hair, until it is dry. Finally, the method is repeated for additional sections of hair, until all sections are completely dry.

The method of blow drying hair according to the invention ensures that the hair has a smooth, glossy and uniform finish. This is due to the design of the hairdryer attachment according to the invention, specifically the arrangement of air channels within the outlet section which dictates the angles at which air is directed to the section of hair. In addition, due to the design of the hairdryer attachment, the method of blow drying hair according to the invention can easily be carried out by an untrained person at home to achieve a professional, salon-style finish. Furthermore, as a result of the ergonomic design of the hairdryer attachment, the method of blow drying hair reduces the need for professional hairstylists to stand in an abducted position and make repetitive and forceful movements with their arms. Ultimately, this can prevent injuries.

The invention claimed is:

1. A hairdryer attachment, comprising:

an inlet section for receiving a flow of air in a first direction;

an outlet section comprising an arcuate portion, the arcuate portion comprising a radius of curvature such that it can accommodate a rounded barrel brush; and a plurality of air channels located within the outlet section for turning and separating the flow of air into a plurality of streams of air, the plurality of air channels defined by a plurality of vanes arranged around the arcuate portion, wherein the plurality of air channels are arranged around the arcuate portion in successively angularly offset directions relative to each other, such that in use the orientation of the vanes around the arcuate portion causes each of the streams of air exit substantially tangentially to the circumference of the rounded barrel brush (219) when the rounded barrel brush (219) is positioned adjacent to the outlet section (103) with the arcuate portion accommodating the rounded barrel brush.

2. The hairdryer attachment according to claim 1, wherein the radius of curvature of the arcuate portion is at least 2 cm.

3. The hairdryer attachment according to claim 1, wherein adjacent air channels are of different lengths.

4. The hairdryer attachment according to claim 1, wherein the vanes are curved over at least a section of their length.

5. The hairdryer attachment according to claim 4, wherein the vanes are connected to side walls.

6. The hairdryer attachment according to claim 1, comprising at least three air channels.

7. The hairdryer attachment according to claim 1, comprising at least five air channels.

8. The hairdryer attachment according to claim 1, wherein the inlet section is a cylindrical section, for attaching to an outlet of a hairdryer.

9. The hairdryer attachment according to claim 1, wherein the inlet section further comprises a rotatable joint.

10. The hairdryer attachment according to claim 1, wherein the hairdryer attachment is manufactured from a high temperature plastic.

11. A hairdryer comprising the hairdryer attachment according to claim 1.

12. The hairdryer according to claim 11, wherein the hairdryer attachment is detachable from the hairdryer.

13. A method for blow drying hair with the hairdryer according to claim 11, the method comprising:

(i) placing a section of hair around a brush;

(ii) positioning the brush adjacent the outlet section of the hairdryer attachment;

(iii) directing a flow of air from the hairdryer over the brush;

(iv) simultaneously pulling the hairdryer and brush towards free ends of the hair, such that the flow of air is brought into contact with the length of the section of hair;

(v) repeating steps (i) to (iv).

14. The method according to claim 13, wherein, during step (iii), the section of hair is held in place for 5 to 10 seconds before commencing step (iv), so as to dry the hair.

15. A computer-readable medium having computer-executable instructions adapted to cause a 3D printer to print the hairdryer attachment according to claim 1 in an additive manufacturing process.

* * * * *